US006443112B1

(12) United States Patent
Kinugawa

(10) Patent No.: US 6,443,112 B1
(45) Date of Patent: Sep. 3, 2002

(54) VALVE TIMING ADJUSTING APPARATUS OF INTERNAL COMBUSTION ENGINE

(75) Inventor: Hiroyuki Kinugawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/799,804

(22) Filed: Mar. 7, 2001

(30) Foreign Application Priority Data

Aug. 18, 2000 (JP) ..... 2000-248609

(51) Int. Cl.[7] ..... F01L 1/344; F02D 13/02
(52) U.S. Cl. ..... 123/90.17
(58) Field of Search ..... 123/90.15, 90.17, 123/90.31; 74/568 R

(56) References Cited

U.S. PATENT DOCUMENTS 5,924,395 A * 7/1999 Moriya et al. ..... 123/90.15
6,058,897 A * 5/2000 Nakayoshi ..... 123/90.17
6,079,382 A * 6/2000 Schafer et al. ..... 123/90.17
6,311,655 B1 * 11/2001 Simpson et al. ..... 123/90.17

FOREIGN PATENT DOCUMENTS

JP 1-92054 4/1989
JP 10-227236 8/1998
JP 11-210424 8/1999

* cited by examiner

*Primary Examiner*—Wellun Lo
(74) *Attorney, Agent, or Firm*—Sughrue Mion, PLLC

(57) ABSTRACT

A valve timing adjusting apparatus of an internal combustion engine in which number of lock pins is decreased is provided. The valve timing adjusting apparatus of an internal combustion engine comprises: a housing which is mounted on a camshaft 2 of the internal combustion engine so as to be relatively rotatable, has a plurality of fluid chambers partitioned by shoes inside, and is driven synchronously by a crankshaft of the internal combustion engine; a rotor which is mounted on the camshaft 2 and has a plurality of vanes for partitioning the plurality of fluid chambers into advancing chambers and/or retarding chambers; a lock pin which is stored in the rotor and is urged so as to be movable toward the housing; and first and second engaging portions which are formed on the housing at different positions of relative rotation of the rotor with respect to the housing and respectively face the lock pin; in which the rotor is regulated to be at the different positions of relative rotation with respect to the housing by engaging the same lock pin with the first and second engaging portions respectively.

11 Claims, 10 Drawing Sheets

VALVE TIMING ADJUSTING APPARATUS OF INTERNAL COMBUSTION ENGINE

BACKGROUND OF THE INVENTION

1. Technical Field

The present invention relates to a valve timing adjusting apparatus of an internal combustion engine.

2. Background Art

In the field of valve timing adjusting apparatus for adjusting timing of opening and closing an intake valve or an exhaust valve of an internal combustion engine, when it is necessary to establish at least two regulation angles for regulating relative rotation of a housing and a rotor, a construction provided with one lock pin has been heretofore proposed for regulating relative rotation of the housing and the rotor for each regulation angle, as disclosed in the Japanese Patent Publication (unexamined) No. 227236/1998. That is, the apparatus has been constructed to have two lock pins when two regulation angles are established.

Fabrication of the regulation angles and accuracy in positioning them on a lock pin storing side as well as on an engaging side are secured by machining. Therefore, a problem exists in that it is necessary to fabricate two regulation angles accurately on each of the lock pin storing side and the engaging side in manufacturing the conventional apparatus.

SUMMARY OF THE INVENTION

The present invention was made to resolve the above-discussed problems and has an object of obtaining a valve timing adjusting apparatus of an internal combustion engine in which number of lock pins is decreased by regulating relative rotation at two places using the same lock pin which regulates relative rotation of both housing and rotor.

A valve timing adjusting apparatus of an internal combustion engine according to the invention comprises: a housing which is mounted on a camshaft of the internal combustion engine so as to be relatively rotatable, has a plurality of fluid chambers partitioned by shoes inside, and is driven synchronously by a crankshaft of the internal combustion engine; a rotor which is mounted on the camshaft and has a plurality of vanes for partitioning the plurality of fluid chambers into advancing chambers and/or retarding chambers respectively; a lock pin which is stored in the rotor and is urged so as to be movable toward the housing; and first and second engaging portions which are formed on the housing at different positions of relative rotation of the rotor with respect to the housing and respectively face the lock pin; in which the rotor is regulated to be at the different positions of relative rotation with respect to the housing by engaging the same lock pin with the first and second engaging portions respectively. As a result, number of the lock pins can be decreased and the housing can be small-sized.

It is preferable that the apparatus further comprises an advancing chamber oil passage for applying oil pressure to the advancing chambers and a lock pin oil passage for applying oil pressure to move the lock pin against urging force that urges the lock pin. As a result, it is possible to control the apparatus with oil pressure, decrease number of the lock pins, and obtain a small-sized housing.

It is preferable that oil pressure is applied to the lock pin oil passage independently of the advancing chamber oil passage. As a result, the lock pin is controlled easily and accurately.

It is preferable that the lock pin oil passage is provided with a control valve for controlling application and release of oil pressure to the lock pin oil passage. As a result, the control becomes accurate.

It is preferable that, by applying oil pressure to the lock pin oil passage, an end of the lock pin and the first engaging portion are disengaged and the other end of the lock pin and the second engaging portion are engaged. As a result, the disengagement of the lock pin with the first engaging portion (for example, extracting direction) and the engagement of the lock pin with the second engaging portion (for example, inserting direction) are both performed in the same direction. Thus, response characteristic is improved, and control can be performed with less switching of oil pressure.

It is preferable that each of the fluid chambers is partitioned into the advancing chamber and the retarding chamber with vanes of the rotor, and the retarding chamber is provided with a retarding urging member. As a result, return response characteristic to the retarding side is improved.

It is preferable that the regulating positions of relative rotation of the rotor with respect to the housing are established to be at a maximum retarding position and an approximately intermediate angle position within a variable angular range of relative rotation of the rotor. As a result, it is possible to make a delicate control.

It is preferable that the lock pin has an integral configuration in which plural cylinders are coaxially arranged. As a result, the lock pin is fabricated easily.

It is preferable that an end of the lock pin is engaged with the first engaging portion of the housing and the other end of the lock pin is engaged with the second engaging portion of the housing. As a result, the disengagement of the lock pin with the first engaging portion (for example, extracting direction) and the engagement of the lock pin with the second engaging portion (for example, inserting direction) are both performed in the same direction. Thus, response characteristic is improved, and control can be performed with less switching of oil pressure.

A valve timing adjusting apparatus of an internal combustion engine according to the invention comprises: a housing which is mounted on a camshaft of the internal combustion engine so as to be relatively rotatable, has a plurality of fluid chambers partitioned by shoes inside, and is driven synchronously by a crankshaft of the internal combustion engine; a rotor which is mounted on the camshaft and has a plurality of vanes for partitioning the plurality of fluid chambers into advancing chambers and retarding chambers respectively; a lock pin which is stored in the rotor and is urged so as to be movable toward the housing; first and second engaging portions which are formed on the housing at different positions of relative rotation of the rotor with respect to the housing and respectively face the lock pin; a first oil passage for applying oil pressure to the advancing chamber; a second oil passage for applying oil pressure to the retarding chamber; and a third oil passage for applying oil pressure which moves the lock pin against urging force that urges the lock pin; in which the rotor is regulated to be at the different positions of relative rotation with respect to the housing by engaging the same lock pin with the first and second engaging portions respectively, and one end of the lock pin and the first engaging portion are disengaged and the other end of the lock pin and the second engaging portion are engaged by applying oil pressure to the third oil passage. As a result, number of the lock pins is decreased and the housing is small-sized. Accurate control is achieved because the advancing chamber is controlled by the first oil passage and the retarding chamber is controlled by the second oil passage, and balance of the two separate controls makes the entire control.

A valve timing adjusting apparatus of an internal combustion engine according to the invention comprises: a housing which is mounted on a camshaft of the internal combustion engine so as to be relatively rotatable, has a plurality of fluid chambers partitioned by shoes inside, and is driven synchronously by a crankshaft of the internal combustion engine; a rotor which is mounted on the camshaft and has a plurality of vanes for partitioning the plurality of fluid chambers into advancing chambers respectively; a first lock pin which is stored in the rotor and is urged so as to be movable toward the housing; first and second engaging portions which are formed on the housing at different positions of relative rotation of the rotor with respect to the housing and respectively face the first lock pin; a second lock pin which is stored in the rotor and is urged so as to be movable toward the housing; and third and fourth engaging portions which are formed at positions of the third and fourth relative rotation which are different from the positions of the first and second relative rotation on the housing and respectively face the second lock pin; in which the rotor is regulated to be at positions of multistage relative rotation with respect to the housing by engaging the first lock pin with the first and second engaging portions respectively and engaging the second lock pin with the third and fourth engaging portions respectively. As a result, it is possible to make a delicate control. Number of the lock pins can be decreased due to multistage control, and the housing can be small-sized.

DESCRIPTION OF THE PREFERRED EMBODIMENTS

Embodiment 1

Figure 1:
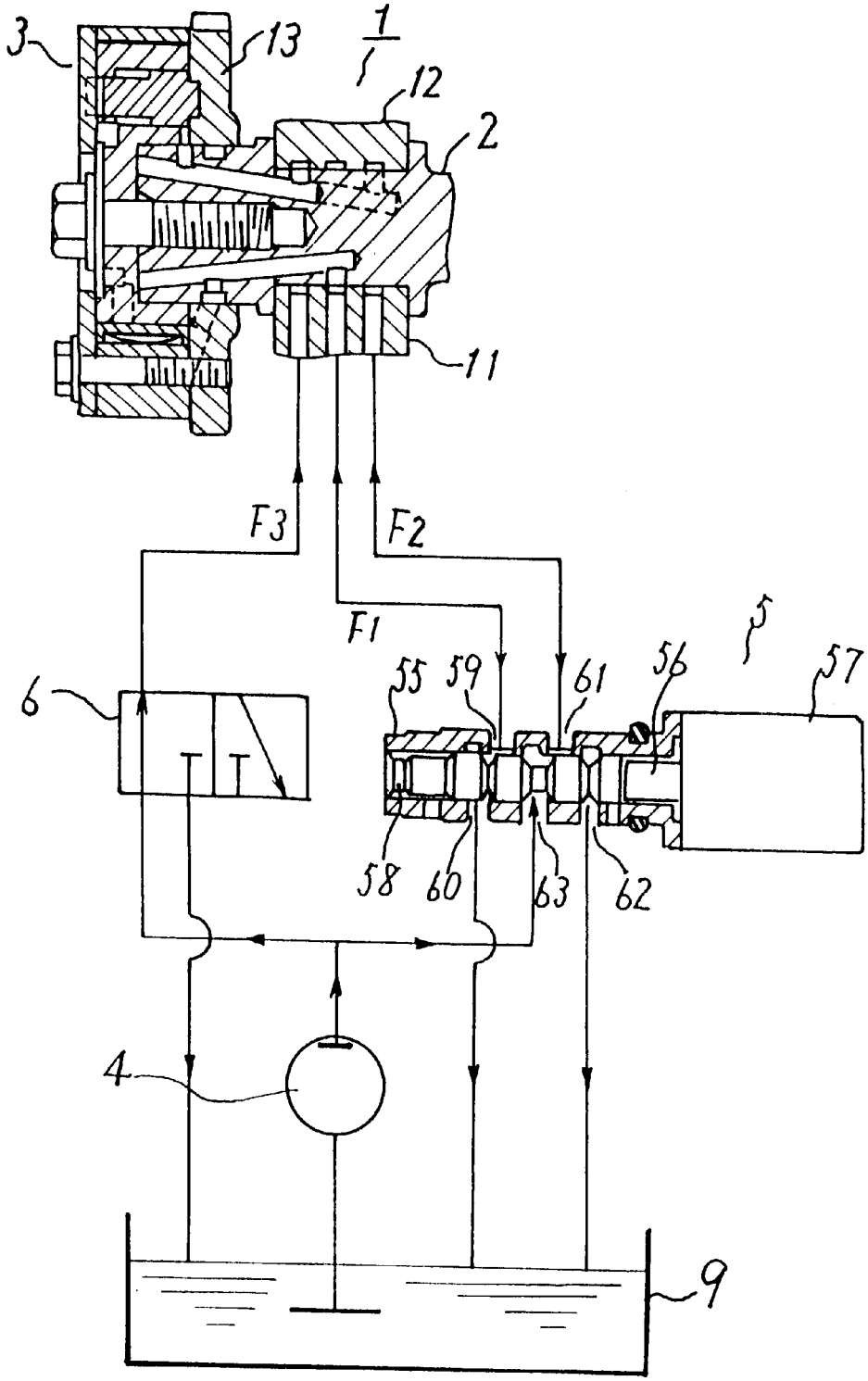
FIG. 1 is a schematic view showing a schematic construction of a valve timing adjusting apparatus of an internal combustion engine according to Embodiment 1 of the present invention.
Figure 2:
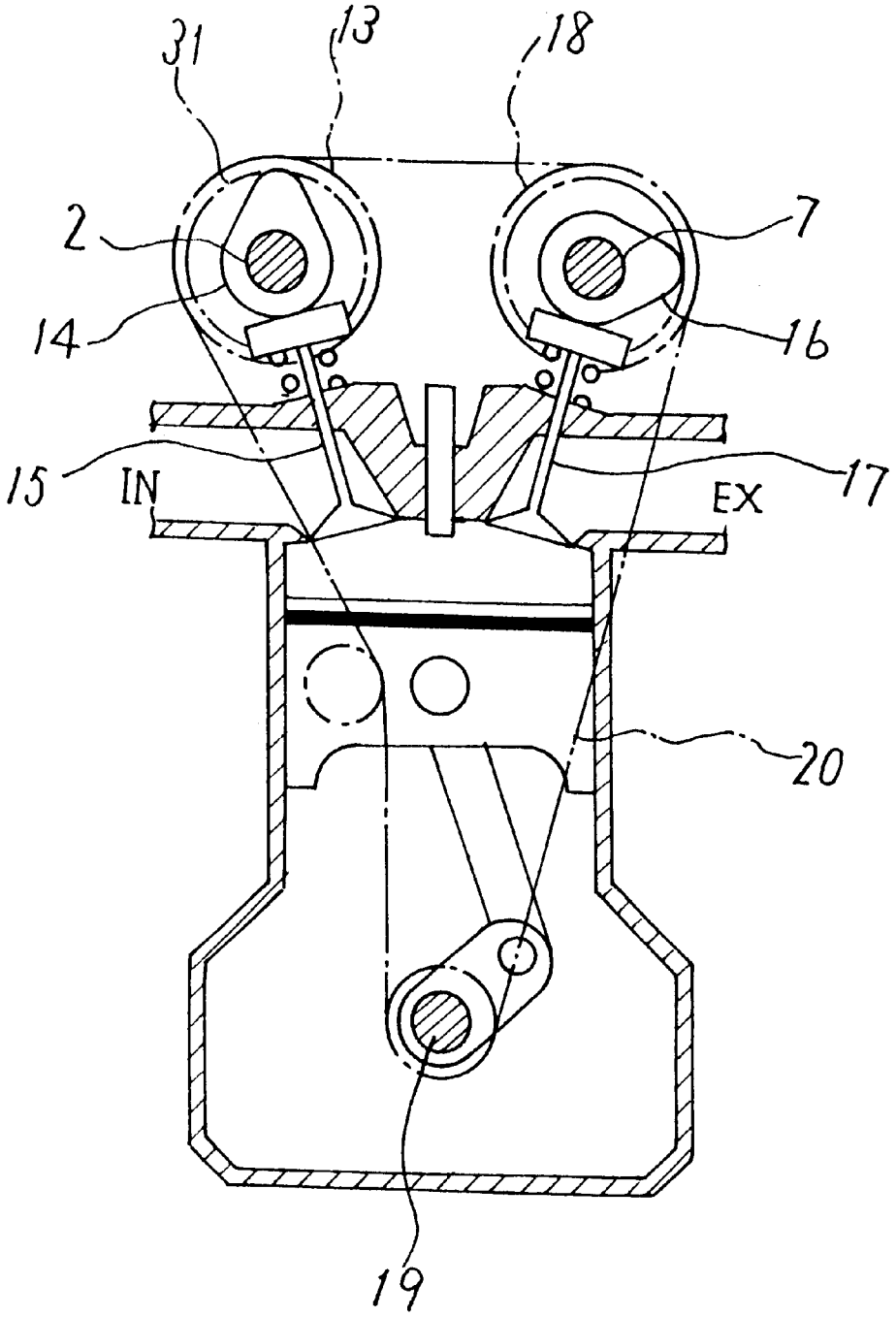
FIG. 2 is an explanatory view showing camshafts mounted on a crankshaft.
Figure 3:
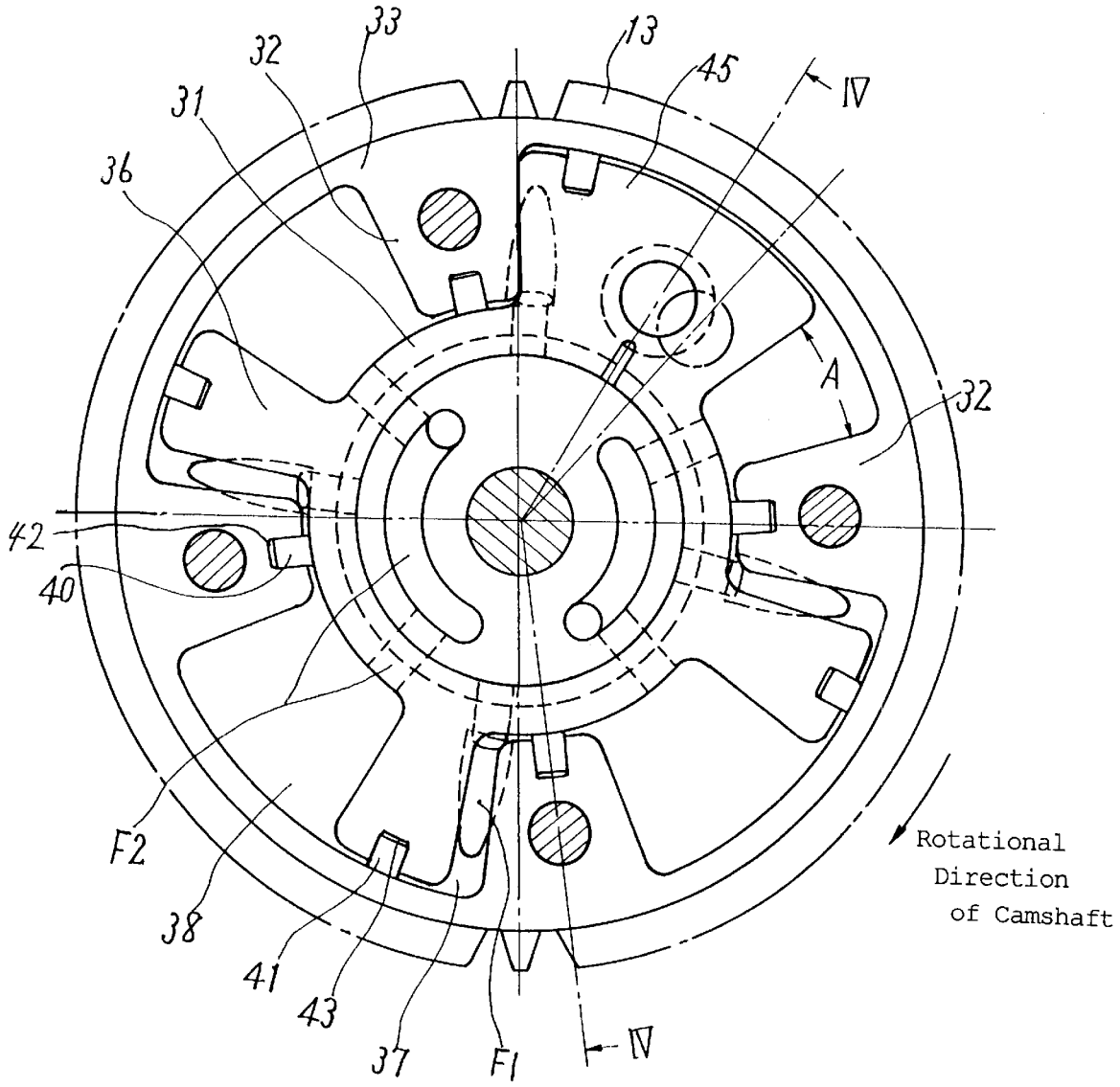
FIG. 3 is a sectional view of the valve timing adjusting apparatus according to Embodiment 1 taken along the line III—III of FIG. 4.
Figure 4:
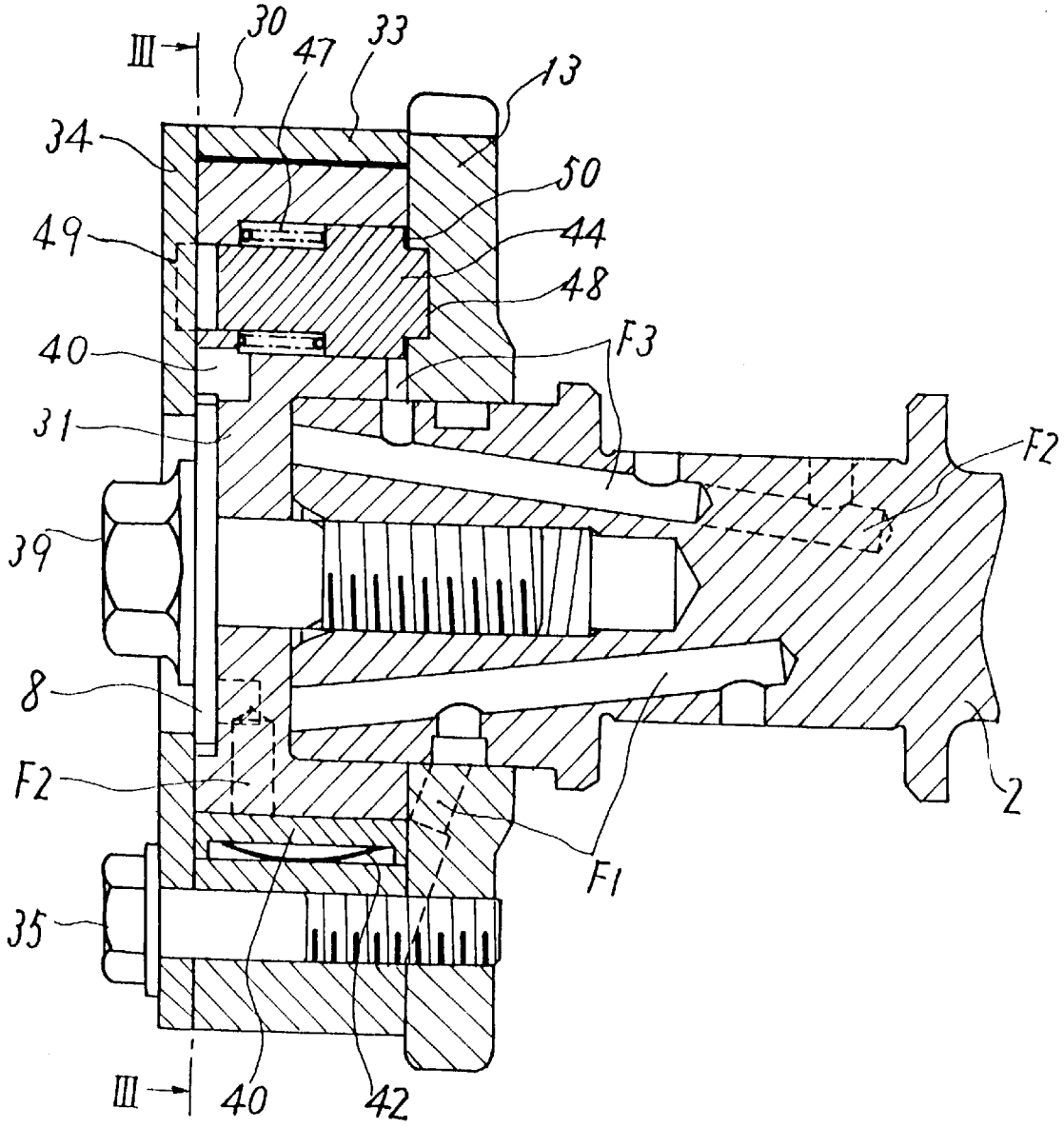
FIG. 4 is a sectional view of the valve timing adjusting apparatus according to Embodiment 1 taken along the line IV—IV of FIG. 3.
Figure 5:
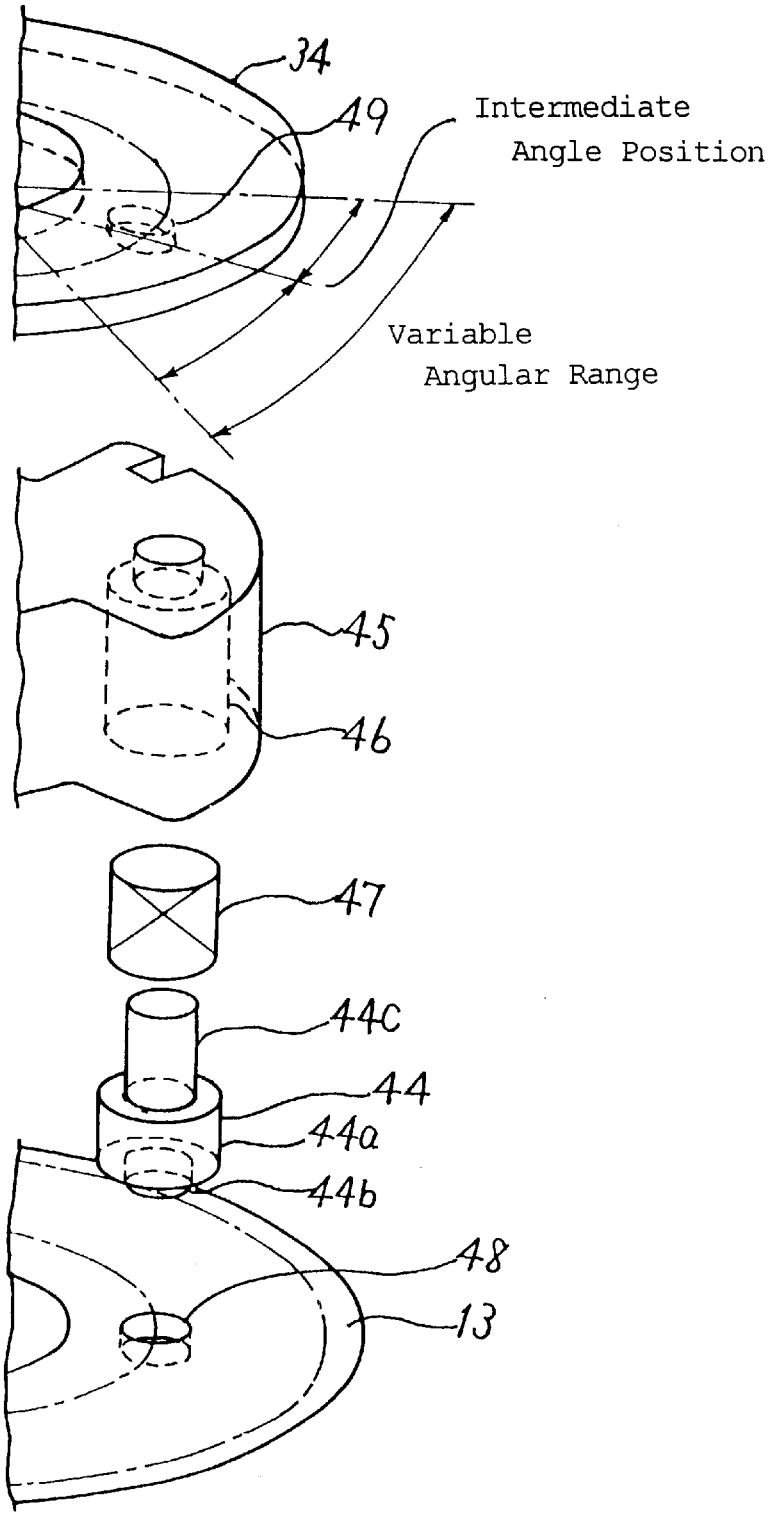
FIG. 5 is an explanatory view in the form of an exploded perspective view showing the relation between a lock pin and engaging portions of the valve timing adjusting apparatus according to Embodiment 1.
Figure 6:
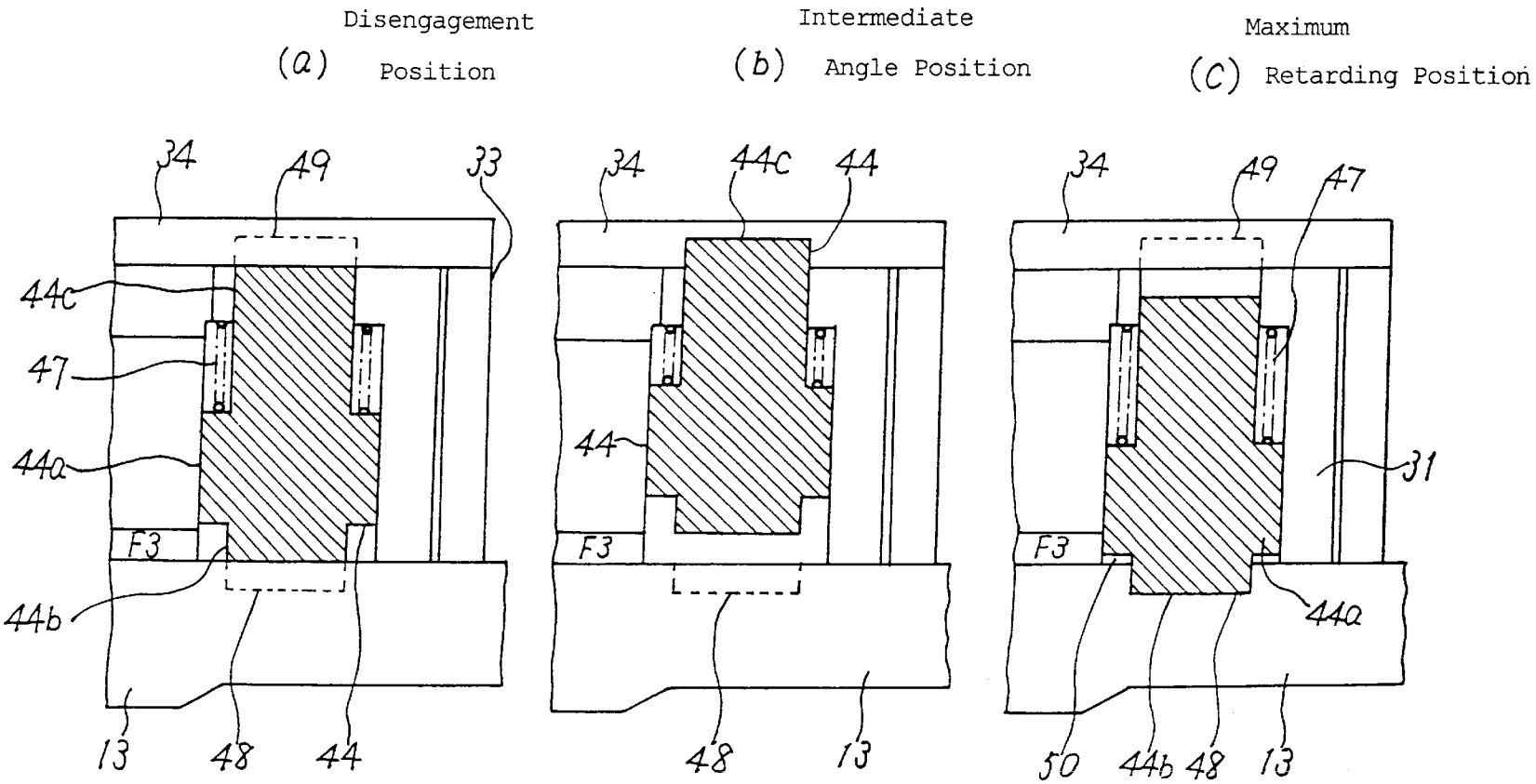
FIGS. 6 (*a*), (*b*) and (*c*) are views explaining operation of the lock pin of the valve timing adjusting apparatus according to Embodiment 1.

Embodiments of the present invention are hereinafter described with reference to the accompanying drawings. FIG. 1 is a schematic view showing a schematic construction of a valve timing adjusting apparatus of an internal combustion engine according to Embodiment 1 of the present invention. FIG. 2 is an explanatory view showing camshafts mounted on a crankshaft. FIG. 3 is a sectional view of the valve timing adjusting apparatus according to Embodiment 1 taken along the line III—III of FIG. 4, with the washer 8 at the center removed. FIG. 4 is a sectional view of the valve timing adjusting apparatus according to Embodiment 1 taken along the line IV—IV of FIG. 3. FIG. 5 is an explanatory view in the form of an exploded perspective view showing the relation between a lock pin and engaging portions of the valve timing adjusting apparatus according to Embodiment 1. FIGS. 6 (*a*), (*b*) and (*c*) are views explaining operation of the lock pin of the valve timing adjusting apparatus according to Embodiment 1.

In FIG. 1, a valve timing adjusting apparatus 1 is provided with a phase shifting mechanism 3 attached to a camshaft 2 (on the intake side or the exhaust side), an oil pump 4 which sends oil from an oil pan 9 to the phase shifting mechanism 3 utilizing driving force of an engine as the power source, and a first oil control valve 5 and a second oil control valve 6 which change the oil passage of the oil to be sent by the oil pump 4 and are controlled by a computer.

The camshaft 2 is rotatably supported by a bearing cap 12 and an upper end face of a cylinder head 11 of the engine. One cam 14 is fixed on the camshaft 2 (for example, the camshaft 2 is on the intake side.) for each cylinder of the engine on the right end side in FIG. 1 as shown in FIG. 2. An upper end portion of an intake valve 15 arranged for each cylinder of the engine comes in contact with each cam 14, and the intake valve 15 is opened and closed by rotating the cam 14 along with the intake side camshaft 2. Another cam 16 is fixed on an exhaust side camshaft 7 for each cylinder of the engine. An upper end portion of one exhaust valve 17 arranged for each cylinder of the engine comes in contact with each cam 16, and the exhaust valve 17 is opened and closed by rotating the cam 16 along with the exhaust side camshaft 7.

In FIG. 1, the camshaft 2 is rotatably capped with a sprocket 13 on the left end side from a supporting position of the bearing cap 12. External teeth are formed on an outer circumferential portion of the sprocket 13. As shown in FIG. 2, a timing chain 20 is put around the intake side sprocket 13, an exhaust side sprocket 18, and a crank pulley attached to an end portion of a crankshaft 19. Consequently, rotation of the intake side and exhaust side sprockets 13, 18 and rotation of the crankshaft 19 are synchronously performed.

The phase shifting mechanism 3 is, as shown in FIG. 3 and FIG. 4, provided with a housing 30 which is substantially hollow and a rotor 31 which is inserted in the housing 30 so as to be relatively rotatable only in a predetermined angular range. The housing 30 has the sprocket 13 and four shoes 32 protruding inwardly in the radial direction. The housing 30 has a construction in which a bolt 35 fixes a cover 34 and a case 33 forming four fluid chambers, that is, hydraulic chambers between the shoes 32. The housing 30 rotates together with the sprocket 13. The rotor 31 has four vanes 36 protruding outwardly in the radial direction. Each of the four hydraulic chambers is partitioned into advancing hydraulic chambers, that is, an advancing hydraulic chamber 37 and a retarding chamber, that is, a retarding hydraulic chamber 38 by the four vanes 36 and the four shoes 32. The rotor 31 is fixed on the camshaft 2 with a bolt 39 interposing a washer 8 between the camshaft 2 and the bolt 39. The rotor 31 is relatively rotatable in a predetermined angular range, and rotates together with the camshaft 2 and along with the housing 30.

In order to prevent oil from leaking out of a gap between the advancing hydraulic chamber 37 and the retarding hydraulic chamber 38, a seal 40, 41 and plate springs 42, 43 for urging the seal 40, 41 are provided, in a slit formed in the axial direction, at an end portion of each of the shoes 32 and the vanes 36.

The rotor 31 is rotatably inserted in the housing 30 and can rotate with respect to the housing 30 (the case 33) in a range of A in FIG. 3. Thus, the rotor 31 has a rotational phase with respect to the housing 30 by the rotational angle. The housing 30 rotates synchronously with the crankshaft 19, and therefore it may be said that the rotational phase is arranged with respect to the crankshaft 19. It is, therefore, possible to change the rotational phase of the camshaft 2 with respect to the crankshaft 19 by adjusting the position of the rotor 31 with respect to the housing 30, that is, adjusting the sizes of the advancing hydraulic chamber 37 and the retarding hydraulic chamber 38. Such change of rotational phase can be performed by supplying (or discharging) oil from the first oil control valve 5 to an advancing side oil passage F1 and a retarding side oil passage F2 communicating to the advancing hydraulic chamber 37 and the retarding hydraulic chamber 38 and by supplying (or discharging) oil from the second oil control valve 6 to a lock pin oil passage F3 to move a lock pin 44.

The four vanes 36 of the rotor 31 include a wide vane 45. As shown in FIG. 5 and FIG. 6, a storing hole, that is, a through hole 46 having a difference in level in the axial direction of the camshaft 2 is formed on the wide vane 45. The lock pin 44, which is shaped into a cylinder with three stages having a cylinder of smaller diameter on each of both ends of the cylinder, is slidably inserted in the through hole 46 in the axial direction. Reference numeral 44*a* is a large diameter portion of the lock pin 44, numeral 44*b* is a small diameter portion of the lock pin 44 on the sprocket 13 side, and numeral 44*c* is a small diameter portion of the lock pin 44 on the cover 34 side. A spring 47 is arranged between the large diameter portion 44*a* of the lock pin 44 and the difference in level of the through hole 46 in order to urge the lock pin 44 toward the sprocket 13.

An engaging portion, that is, a first engaging hole 48 where the small diameter portion 44*b* of the lock pin 44 can be inserted when the relative angle of the rotor 31 inserted into the housing 30 is at a maximum retarding position, that is, when the position in FIG. 3 is formed on the sprocket 13. The rotational phase of the rotor 31 is regulated to be at the maximum retarding side by inserting the small diameter portion 44*b* of the lock pin 44 into the first engaging hole 48 utilizing the urging force of the spring 47. An engaging portion, that is, a second engaging hole 49 where the small diameter portion 44*c* of the lock pin 44 can be inserted when the relative angle of the rotor 31 inserted into the housing 30 is at an intermediate angle position in a variable angular range is formed on the cover 34 of the housing 30. The rotational phase of the rotor 31 is regulated to be at the intermediate angle position in the variable angular range by inserting the small diameter portion 44*c* of the lock pin 44 into the second engaging hole 49. As described above, the lock pin 44 regulates relative rotation of the housing 30 and the rotor 31. The whole length of the lock pin 44 is smaller than the thickness of the rotor 31, and the rotor 31 can be rotated relatively in the housing 30 even when the lock pin 44 is engaged with neither of the first and second engaging holes.

In FIG. 4 and FIG. 6, note that a ring-shaped opening 50 is formed between a face on the rotor 31 side of the sprocket 13 and a face on the sprocket 13 side of the large diameter portion 44*a* of the lock pin 44 even under the condition that the small diameter portion 44*b* of the lock pin 44 is inserted in the first engaging hole 48 and an end of the small diameter portion 44*b* is seated on the bottom of the first engaging hole 48 (i.e., under the condition shown in FIG. 4 and FIG. 6(*c*)). Therefore, when oil is supplied from the second oil control valve 6 (FIG. 1) to the oil passage F3 communicating to the ring-shaped opening 50, the face on the sprocket 13 side of the large diameter portion 44*a* serves as a pressure receiving face. Thus, it is possible to move the lock pin 44 toward the opposite side of the sprocket 13 side by oil pressure against the urging force of the spring 47. As a result, the rotational phase of the rotor 31 is released from the regulation on the maximum retarding side, and this makes it possible to rotate the rotor 31 to the advancing side. In other words, the rotor 31 shifts from the maximum retarding position (c) to the disengagement position (a) in FIG. 6.

Further, oil is supplied to the oil passage F3 at the disengagement position (a). When the relative angle of the rotor 31 inserted into the housing 30 comes to the intermediate angle position in the variable angular range, the lock pin 44 is moved toward the cover 34 by oil pressure, the small diameter portion 44*c* of the lock pin 44 is inserted into the second engaging hole 49 of the cover 34, and the rotor 31 shifts to the intermediate angle position (b) in FIG. 6. Therefore, the rotational phase of the rotor 31 is regulated to be at the intermediate angle position in the variable angular range. There is a possibility that some oil leaks out on the spring 47 side when oil pressure is applied to the oil passage F3, and the leaked out oil is discharged from a return hole 40 (FIG. 4) to outside.

The first oil control valve 5 is, as shown in FIG. 1, provided with a casing 55, a spool 56 inserted into the casing 55, an electromagnetic solenoid 57 for driving the spool 56 in the axial direction, and a spring 58 for urging the spool 56 toward the electromagnetic solenoid 57 side. Formed on the casing 55 are an advancing side port 59 connected to the advancing side oil passage F1, an advancing side drain port 60 for discharging oil, which has flown in from the advancing side oil passage F1, into the oil pan 9, a retarding side port 61 connected to the retarding side oil passage F2, a retarding side drain port 62 for discharging oil, which has flown in from the retarding side oil passage F2, into the oil pan 9, and an inflow port 63 where oil sent from the oil pump 4 flows in.

By moving the spool 56 to the right in FIG. 1 to be put in the condition as shown FIG. 1, communicating the inflow port 63 to the retarding side port 61, and communicating the advancing side port 59 to the advancing side drain port 60, oil is supplied to the retarding hydraulic chamber 38 (FIG. 3) through the oil passage F2 the retarding side (FIG. 1, FIG. 4, FIG. 3) and oil is discharged from the advancing hydraulic chamber 37 through the oil passage Fl on the advancing side (FIG. 3, FIG. 4, FIG. 1), thus the rotor 31 can be rotated to the retarding side. On the other hand, by moving the spool 56 to the left in FIG. 1, communicating the inflow port 63 to the advancing side port 59, and communicating the retarding side port 61 to the retarding side drain port 62, oil is supplied to the advancing hydraulic chamber 37 (FIG. 3) through the oil passage F1 on the advancing side (FIG. 1, FIG. 4, FIG. 3) and oil is discharged from the retarding hydraulic chamber 38 through the oil passage F2 on the retarding side (FIG. 3, FIG. 4, FIG. 1), thus the rotor 31 can be rotated to the advancing side. In addition, by making a duty control of the voltage applied to the electromagnetic solenoid 57, it becomes possible to adjust the balancing position of the spool 56 and the spring 58, adjust the flowing amount of oil to be supplied, close both of the advancing side port 59 of the advancing side oil passage F1 and the retarding side port 61 of the retarding side oil passage F2 at the same time when necessary, and keep the relative rotation angle at the desired value.

The second oil control valve 6 is, as shown in FIG. 1, a switching valve. At the first position shown in the drawing, oil is supplied from the oil pump 4 to the oil passage F3 (FIG. 1, FIG. 4) and oil pressure is applied (ON) to the lock pin 44. When the second oil control valve 6 is switched from the first position to the second position, the oil which has flown in from the oil passage F3 is discharged into the oil pan 9 and the lock pin 44 is released (OFF) from oil pressure.

Provided in this Embodiment 1 is a valve timing adjusting apparatus having the advancing hydraulic chamber and the retarding hydraulic chamber, in which continuous and variable control is made, a desired position is maintained by oil pressure of the advancing hydraulic chamber and the retarding hydraulic chamber, and a lock pin is used at the intermediate angle position only when the control is not stable at the engine starting. Described below is the manner of locking or maintaining at the desired position to cope with various conditions.

(1) Shift from Maximum Retarding Position to Intermediate Angle Position

Described hereinafter is a case of changing the relative rotation angle of the crankshaft 19, that is, the housing 30 and the rotor 31 when the oil pressure is established, for example, during the operation of engine. For example, in order to perform a relative rotation to the advancing side when the initial condition is at the maximum retarding position in which any oil pressure is not applied to each oil passage as shown in FIG. 3 and FIG. 4, in other words, when the small diameter portion 44*b* of the lock pin 44 is inserted into the first engaging hole 48 of the sprocket 13, the second oil control valve 6 is switched to the first position and oil is supplied from the oil pump 4 to the oil passage F3 (F3: ON). Thus, the lock pin 44 moves toward the cover 34 side against the spring 47, and the small diameter portion 44*b* of the lock pin 44 gets out of the first engaging hole 48 of the sprocket 13. In other words, the rotor 31 shifts from the maximum retarding position (c) to the disengagement position (a) in FIG. 6.

Oil is supplied to the advancing hydraulic chamber 37 via the first oil control valve 5 through the oil passage F1 on the advancing side (F1: ON) and oil is discharged from the retarding hydraulic chamber 38 through the oil passage F2 on the retarding side (F2: OFF), and consequently, the rotor 31 rotates to the advancing side. When oil is continuously supplied to the oil passage F3 and the relative angle of the rotor 31 inserted into the housing 30 comes to the intermediate angle position in the variable angular range, the lock pin 44 is moved toward the cover 34 by oil pressure of the oil passage F3 and the small diameter portion 44*c* of the lock pin 44 is inserted into the second engaging hole 49 of the cover 34, and the rotor 31 shifts to the intermediate angle position (b) in FIG. 6. The rotor 31 is regulated to be at the intermediate angle position by continuously supplying oil to the oil passage F3.

As an example of regulating the rotor at the intermediate angle position, when the engine is started at the maximum retarding position and oil temperature thereof is low, an attempt is made to hold the valve timing adjusting apparatus at the intermediate angle position. However, "the oil viscosity" is high and the feed back control lacks stability, therefore in some cases the apparatus is forcedly held at the intermediate angle position using the lock pin.

(2) Shift from Intermediate Angle Position to Maximum Advancing Position

In order to shift the rotor 31 from the intermediate angle position to the maximum advancing position, the second oil control valve 6 is switched to the second position and oil is discharged from the oil passage F3 (F3: OFF). Thus, the lock pin 44 is moved toward the sprocket 13 by the spring 47, and the small diameter portion 44*c* of the lock pin 44 gets out of the second engaging hole 49. In other words, the rotor 31 shifts from the intermediate angle position (b) to the disengagement position (a) in FIG. 6.

Under such condition, oil is supplied to the advancing hydraulic chamber 37 via the first oil control valve 5 through the oil passage F1 on the advancing side (F1: ON) and oil is discharged from the retarding hydraulic chamber 38 through the oil passage F2 on the retarding side (F2: OFF), and consequently, the rotor 31 further rotates to the advancing side and advances to A/2. The wide vane 45 of the rotor 31 comes in contact with the shoe 32 of the case 33, and the rotor 31 shifts to the maximum advancing position. The rotor 31 is held at the maximum advancing position by continuously applying oil pressure to the advancing side oil passage F1.

Table 1 shows the condition of applying (ON) and releasing (OFF) oil pressure to each oil passage in shifting from Maximum Retarding Position→Intermediate Angle Position→Maximum Advancing Position.

TABLE 1

| | Initial | Maximum Retarding Position | → | Intermediate Angle Position | → | Maximum Advancing Position |
|---|---|---|---|---|---|---|
| Advancing Side Oil Passage F1 | OFF | | ON | | ON | |
| Retarding Side Oil Passage F2 | OFF | | OFF | | OFF | |
| Lock Pin Oil Passage F3 | OFF | | ON | | OFF | |

(3) Shift from Maximum Advancing Position to Intermediate Angle Position

In order to shift the rotor 31 from the maximum advancing position to the intermediate angle position, the second oil control valve 6 is switched to the first position and oil is supplied to the oil passage F3 (F3: ON). Thus, the lock pin 44 becomes movable toward the cover 34 against the spring 47, but the position remains unchanged from the disengagement position (a) in FIG. 6. Under this condition, oil is supplied to the retarding hydraulic chamber 38 via the first oil control valve 5 through the oil passage F2 on the retarding side (F2: ON) and oil is discharged from the advancing hydraulic chamber 37 through the oil passage F1 on the advancing side (F1: OFF), and the rotor 31 rotates to the retarding side.

When oil is continuously supplied to the oil passage F3 and the relative angle of the rotor 31 inserted into the housing 30 comes to the intermediate angle position in the variable angular range, the lock pin 44 is moved toward the cover 34 by oil pressure of the oil passage F3. Thus, the small diameter portion 44*c* of the lock pin 44 can be inserted into the second engaging hole 49 of the cover 34, and the rotor 31 shifts to the intermediate angle position (b) in FIG. 6. The rotor 31 is regulated to be at the intermediate angle position by continuously supplying oil to the oil passage F3.

As an example of regulating the rotor at the intermediate angle position, when making a control such as rapidly returning the rotor from the maximum advancing position to the vicinity of the intermediate angle position, it is possible in some cases to prevent the rotor from shifting from the maximum advancing position excessively to the maximum retarding position resulting in lack of stability, by temporarily holding the rotor at the intermediate angle position with the lock pin and shifting the rotor from the intermediate angle position to a control position.

(4) Shift from Intermediate Angle Position to Maximum Retarding Position

In order to shift the rotor 31 from the intermediate angle position to the maximum retarding position, the second oil control valve 6 is switched to the second position, oil which has flown in from the oil passage F3 is discharged into the oil pan 9, and the lock pin 44 is released from oil pressure (F3: OFF). Thus, the lock pin 44 is moved toward the sprocket 13 by the urging force of the spring 47, and the small diameter portion 44*c* of the lock pin 44 gets out of the second engaging hole 49 of the cover 34. In other words, the rotor 31 shifts from the intermediate angle position (b) to the disengagement position (a) in FIG. 6.

Under this condition, oil is supplied to the retarding hydraulic chamber 38 via the first oil control valve 5 through the oil passage F2 on the retarding side (F2: ON) and oil is discharged from the advancing hydraulic chamber 37 through the oil passage F1 on the advancing side (F1: OFF), and consequently, the rotor 31 rotates to the retarding side. When the oil passage F3 is continuously released from oil pressure and the relative angle of the rotor 31 inserted into the housing 30 comes to the maximum retarding position, the lock pin 44 is moved toward the sprocket 13 by the urging force of the spring 47, the small diameter portion 44*b* of the lock pin 44 is inserted into the first engaging hole 48 of the sprocket 13, and the rotor 31 shifts to the maximum retarding position (c) in FIG. 6. The rotor 31 is regulated to be at the maximum retarding position by not applying oil pressure to the oil passage F3.

Table 2 shows the condition of applying (ON) and releasing (OFF) oil pressure to each oil passage in shifting of Maximum Advancing Position→Intermediate Angle Position→Maximum Retarding Position.

TABLE 2

| | Maximum Retarding Position | ← | Intermediate Angle Position | ← | Maximum Advancing Position |
|---|---|---|---|---|---|
| Advancing Side Oil Passage F1 | | OFF | | OFF | |
| Retarding Side Oil Passage F2 | | ON | | ON | |
| Lock Pin Oil Passage F3 | | OFF | | ON | |

(5) Shift from Maximum Retarding Position to Maximum Advancing Position

Next, in order to shift the rotor 31 from the maximum retarding position to the maximum advancing position at once, oil pressure is applied to the oil passage F3 (F3: ON) and the lock pin 44 shifts from the maximum retarding position (c) to the disengagement position (a) in FIG. 6. Under this condition, oil pressure is applied to the oil passage F1 on the advancing side (F1: ON), and the oil passage F2 on the retarding side is released from oil pressure (F2: OFF). Thus, the rotor 31 starts to rotate to the advancing side. This is detected by a crankshaft angular sensor and a camshaft angular sensor (not shown in the drawings), and the second oil control valve 6 is switched and the oil passage F3 is released from oil pressure (F3: OFF). Oil pressure is continuously applied to the oil passage F1 on the advancing side (F1: ON) and the retarding side oil passage F2 is continuously released from oil pressure (F2: OFF), and consequently, the wide vane 45 of the rotor 31 comes in contact with the shoe 32 of the case 33, and the rotor 31 shifts to the maximum advancing position. The rotor 31 is held at the maximum advancing position by continuously applying oil pressure to the oil passage F1 on the advancing side.

Table 3 shows the condition of applying (ON) and releasing (OFF) oil pressure to each oil passage in shifting of Maximum Retarding Position→Maximum Advancing Position.

TABLE 3

| | Initial | Maximum Retarding Position | → → | Maximum Advancing Position |
|---|---|---|---|---|
| Advancing Side Oil Passage F1 | OFF | | ON | |
| Retarding Side Oil Passage F2 | OFF | | OFF | |
| Lock Pin Oil Passage F3 | OFF | | ON → OFF | |

(6) Shift from Maximum Advancing Position to Maximum Retarding Position

In order to shift the rotor 31 from the maximum advancing position to the maximum retarding position at once, oil pressure is applied to the oil passage F2 on the retarding side (F2: ON) and the oil passage Fl on the advancing side is released from oil pressure (F1: OFF) with the oil passage F3 released from oil pressure (F3: OFF), that is, while the lock pin 44 being at the disengagement position (a) in FIG. 6 and the lock pin 44 being urged toward the sprocket 13 side by the spring 47. Thus, the rotor 31 rotates to the retarding side, passes through the intermediate angle position, and shifts to the maximum retarding position. Accordingly, the small diameter portion 44*c* of the lock pin 44 can be inserted in the first engaging hole 48 of the sprocket 13, and the rotor 31 shifts to the maximum retarding position (c) in FIG. 6. The rotor 31 is regulated to be at the maximum retarding position by not applying oil pressure to the oil passage F3.

The first engaging hole 48 is formed on the sprocket 13 and the second engaging hole 49 is formed on the cover 34, however, it is also preferable to form both of the first and second engaging holes 48, 49 on the sprocket 13. In this case, response to the control requires a time.

Table 4 shows the condition of applying (ON) and releasing (OFF) oil pressure to each oil passage in shifting of Maximum Advancing Position→Maximum Retarding Position.

TABLE 4

| | Maximum Retarding Position | ← ← | Maximum Advancing Position |
|---|---|---|---|
| Advancing Side Oil Passage F1 | | OFF | |
| Retarding Side Oil Passage F2 | | ON | |
| Lock Pin Oil Passage F3 | | OFF | |

As described above, in this Embodiment 1, it is possible to regulate the rotor 31 in the housing 30 to be at the maximum retarding position by engaging the lock pin 44 with the first engaging hole 48 and regulate the rotor 31 in the housing 30 to be at the intermediate angle position by engaging the lock pin 44 with the second engaging hole 49 using the same lock pin 44. It is also possible to shift the rotor 31 further to the maximum advancing position. For that purpose, the same lock pin is engaged with two places to regulate the relative rotation respectively, and therefore number of the lock pins is decreased and the housing is small-sized.

Embodiment 2

Figure 7:
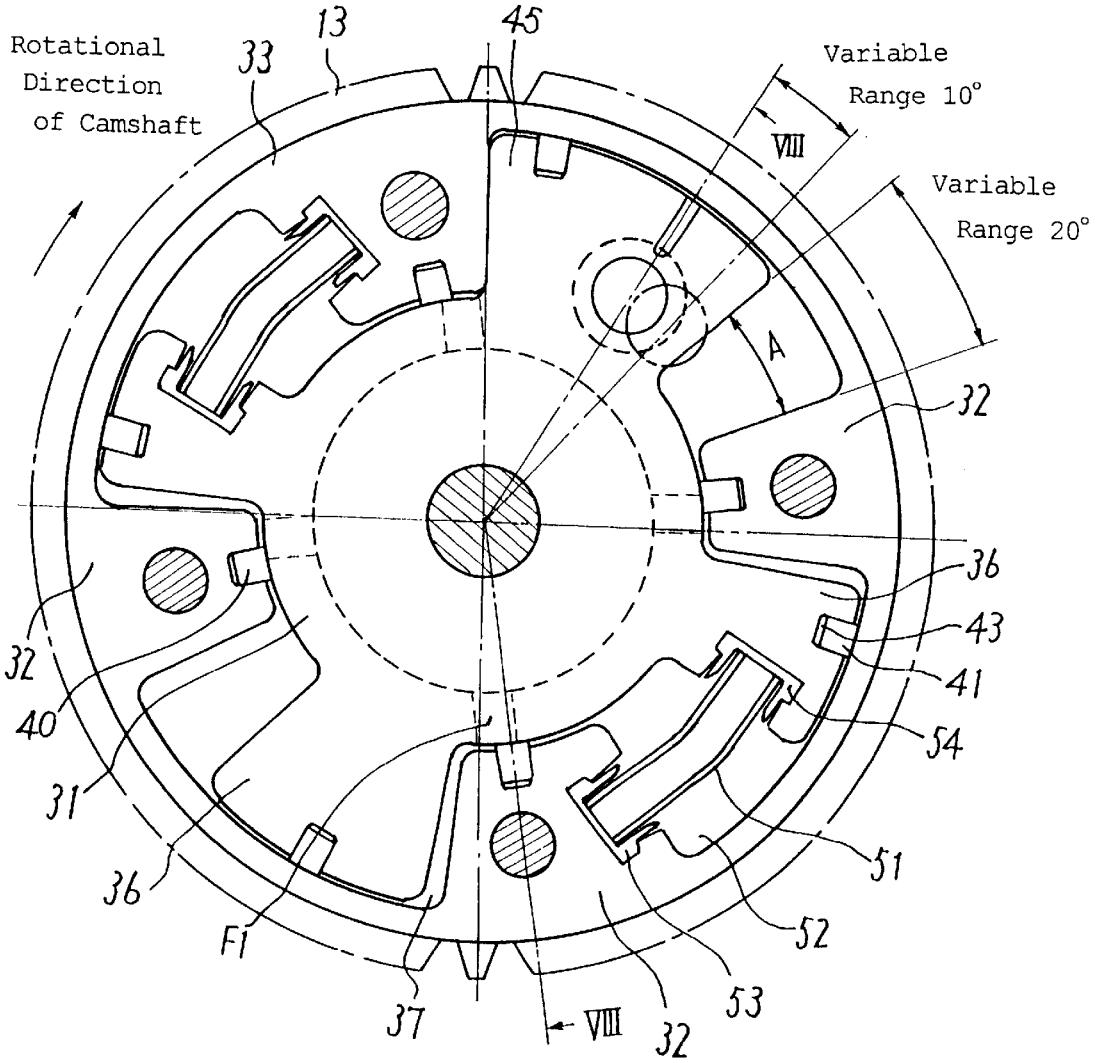
FIG. 7 is a sectional view of a valve timing adjusting apparatus according to Embodiment 2 of the invention taken along the line VII—VII of FIG. 8.
Figure 8:
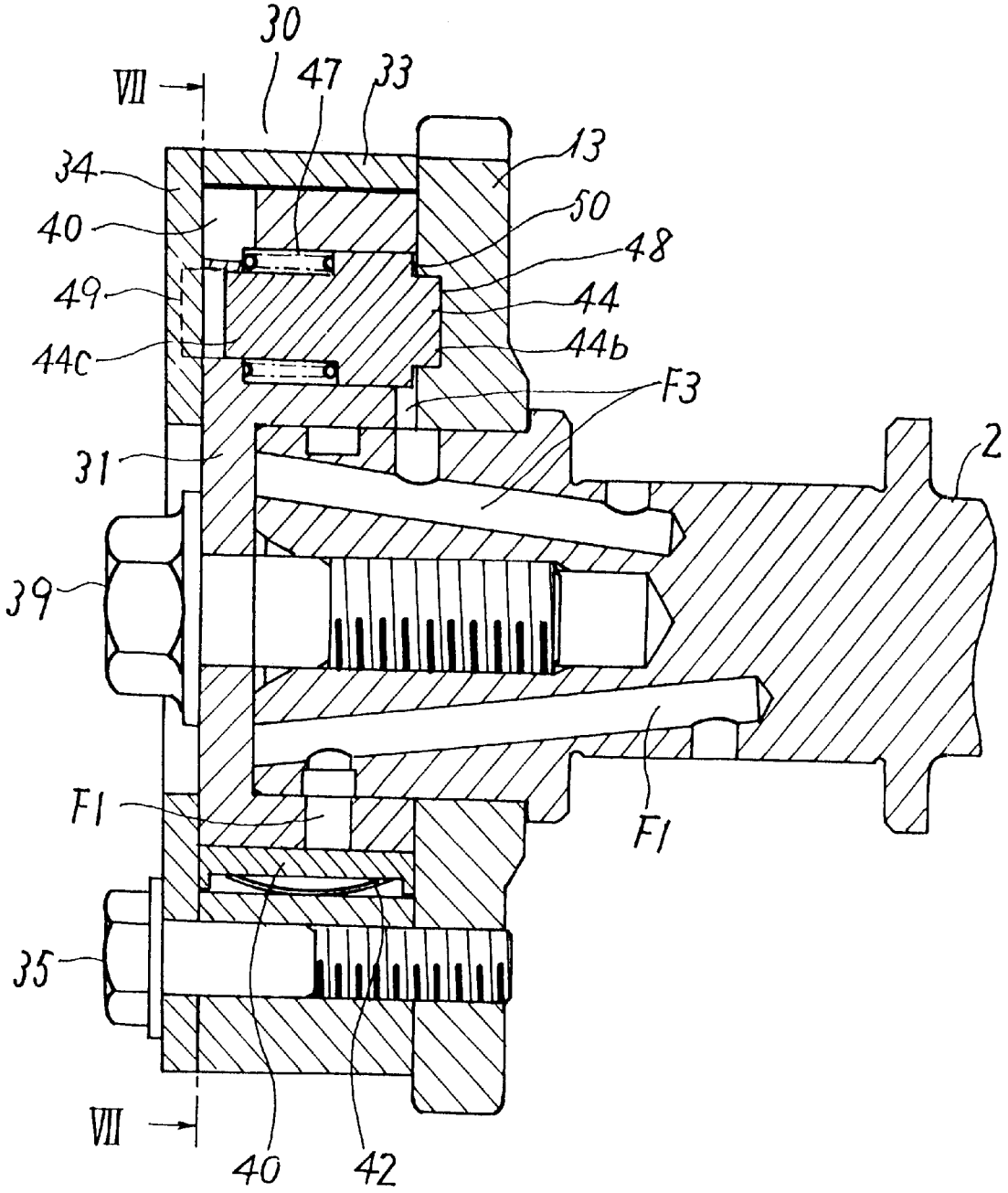
FIG. 8 is a sectional view of the valve timing adjusting apparatus according to Embodiment 2 taken along the line VIII—VIII of FIG. 7.

FIG. 7 is a sectional view of a valve timing adjusting apparatus according to Embodiment 2 of the invention taken along the line VII—VII of FIG. 8. FIG. 8 is a sectional view of the valve timing adjusting apparatus according to Embodiment 2 taken along the line VIII—VIII of FIG. 7. In the drawings, the same reference numerals as those of Embodiment 1 are designated to the same or like parts, and further description thereof is omitted herein.

In the drawings, four fluid chambers, that is, four hydraulic chambers are formed between the four shoes 32 of the case 33 of the housing 30. The hydraulic chambers are partitioned by the four vanes 36 of the rotor 31 which rotates relatively in the housing 30 so as to form the advancing hydraulic chamber 37 in each of the hydraulic chambers. Each of two chambers being symmetrical putting the axis therebetween among the four chambers corresponding to the retarding hydraulic chambers 38 in the foregoing Embodiment 1 is provided with a retarding urging member (spring) 51 for urging the rotor 31 to the retarding side.

The chamber provided with the retarding urging member 51 is an urging member storing chamber 52 for storing the urging member 51, to which oil pressure is not applied. The retarding urging member 51 is inserted into recessed portions 53, 54 of the shoe 32 of the case 33 and the vane 36 of the rotor 31 facing each other. In this Embodiment 2, it is certain that the apparatus is provided with the oil passage F1 on the advancing side for applying and releasing oil pressure to and from the advancing hydraulic chamber 37 and the oil passage F3 for applying and releasing oil pressure to move the lock pin 44 against the spring 47. But, note that the apparatus is not provided with the retarding side oil passage F2 and the washer 8 both existing in the foregoing Embodiment 1. Therefore, the retarding urging member 51 is used for the purpose of improving response speed when the reaction force of the cam received by the rotor in moving to the retarding direction cannot secure enough response speed in the retarding direction. A simple valve is sufficient for the first oil control valve 5 for controlling oil pressure of the advancing side oil passage F1 as well as for the second oil control valve 6. The operation of the lock pin is the same as that in Embodiment 1.

In addition, the foregoing Embodiment 1 is suitable for linear control of relative rotation because it is possible to regulate the relative rotation of the rotor by the balance of the oil pressure of the advancing hydraulic chamber and the oil pressure of the retarding hydraulic chamber. On the other hand, this Embodiment 2 is suitable for discrete control of only three-stage positions of maximum retarding position, intermediate angle position, and maximum advancing position.

(1) Shift from Maximum Retarding Position to Intermediate Angle Position

Described hereinafter is operation of the apparatus according to this Embodiment 2. The cam reaction force and the urging force of the retarding urging member act on the rotor 31 at all times. Angle of relative rotation of the crankshaft 19, that is, between the housing 30 and the rotor 31, is changed as described below. For example, in order to perform a relative rotation to the advancing side when the initial condition is at the maximum retarding position in which any oil pressure is not applied to each oil passage as shown in FIG. 7 and FIG. 8, oil is applied to the oil passage F3 (F3: ON). Thus, the lock pin 44 moves toward the cover 34 side against the spring 47, and the small diameter portion 44*b* of the lock pin 44 gets out of the first engaging hole 48 of the sprocket 13.

Under this condition, when supplying oil to the advancing hydraulic chamber 37 through the oil passage F1 on the advancing side (F1: ON), the rotor 31 rotates to the advancing side against [the cam reaction force and the urging force of the retarding urging member 51]. When the relative angle of the rotor 31 inserted into the housing 30 comes to the intermediate angle position (for example, 10°) in the variable angular range (for example, 20°), the lock pin 44 is moved toward the cover 34 by oil pressure of the oil passage F3, and the small diameter portion 44*c* of the lock pin 44 can be inserted into the second engaging hole 49 of the cover 34. The rotor 31 is regulated to be at the intermediate angle position by continuously applying oil pressure to the oil passage F3.

(2) Shift from Intermediate Angle Position to Maximum Advancing Position

Under such condition, when releasing the oil passage F3 from oil pressure (F3: OFF), the lock pin 44 is moved toward the sprocket 13 side by the spring 47 and the small diameter portion 44*c* of the lock pin 44 gets out of the second engaging portion 49. When supplying oil continuously to the advancing hydraulic chamber 37 through the oil passage F1 on the advancing side (F1: ON), the rotor 31 rotates to the advancing side against the retarding urging member 51 and the wide vane 45 of the rotor 31 comes in contact with the shoe 32 of the housing 30 and the rotor 31 shifts to the maximum advancing position. The rotor 31 is regulated to be at the maximum advancing position by continuously supplying oil to the advancing hydraulic chamber 37 through the oil passage F1 on the advancing side.

Table 5 shows the condition of applying (ON) and releasing (OFF) oil pressure to each oil passage in shifting of Maximum Retarding Position→Intermediate Angle Position→Maximum Advancing Position.

TABLE 5

| | Initial | Maximum Retarding Position | → | Intermediate Angle Position | → | Maximum Advancing Position |
|---|---|---|---|---|---|---|
| Advancing Side Oil Passage F1 | OFF | | ON | | ON | |

TABLE 5-continued

| | Initial | Maximum Retarding Position | → | Intermediate Angle Position | → | Maximum Advancing Position |
|---|---|---|---|---|---|---|
| Lock Pin Oil Passage F3 | OFF | | ON | | OFF | |

(3) Shift from Maximum Advancing Position to Intermediate Angle Position

In order to shift the rotor 31 from the maximum advancing position to the intermediate angle position, oil pressure is applied to the oil passage F3 (F3: ON). Thus, the lock pin 44 becomes movable toward the cover 34 against the spring 47. The oil passage F1 on the advancing side is released from oil pressure (F1: OFF), and consequently, the rotor 31 rotates to the retarding side by [the cam reaction force of the camshaft 2 and the urging force of the retarding urging member 51]. When the relative angle of the rotor 31 inserted into the housing 30 comes to the intermediate angle position in the variable angular range, the lock pin 44 is moved toward the cover 34 by oil pressure of the oil passage F3, and the small diameter portion 44*c* of the lock pin 44 can be inserted into the second engaging hole 49 of the cover 34. The rotor 31 is regulated to be at the intermediate angle position by continuously applying oil pressure to the oil passage F3.

(4) Shift from Intermediate Angle Position to Maximum Retarding Position

In order to shift the rotor 31 from the intermediate angle position to the maximum retarding position, the oil passage F3 is released from oil pressure (F3: OFF), whereby the lock pin 44 is moved toward the sprocket 13 by the urging force of the spring 47 and the small diameter portion 44*c* of the lock pin 44 gets out of the second engaging hole 49 of the cover 34. When releasing oil pressure continuously from the oil passage Fl on the advancing side, the rotor 31 is rotated by [the cam reaction force of the camshaft 2 and the urging force of the retarding urging member 51]. When the relative angle of the rotor 31 inserted into the housing 30 comes to the maximum retarding position, the lock pin 44 is moved toward the sprocket 13 by the urging force of the spring 47. Thus, the small diameter portion 44*b* of the lock pin 44 is inserted into the first engaging hole 48 of the sprocket 13, and the rotor 31 can shift to the maximum retarding position. The rotor 31 is regulated to be at the maximum retarding position by not applying oil pressure to the oil passage F3.

Table 6 shows the condition of applying (ON) and releasing (OFF) oil pressure to each oil passage in shifting of Maximum Advancing Position→Intermediate Angle Position→Maximum Retarding Position.

TABLE 6

| | Maximum Retarding Position | ← | Intermediate Angle Position | ← | Maximum Advancing Position |
|---|---|---|---|---|---|
| Advancing Side Oil Passage F1 | | OFF | | OFF | |
| Lock Pin Oil Passage F3 | | OFF | | ON | |

(5) Shift from Maximum Retarding Position to Maximum Advancing Position

The rotor 31 shifts from the maximum retarding position to the maximum advancing position at once in the same manner as in the foregoing Embodiment 1.

Table 7 shows the condition of applying (ON) and releasing (OFF) oil pressure to each oil passage in shifting of Maximum Retarding Position →Maximum Advancing Position.

TABLE 7

| | Initial | Maximum Retarding Position | → → | Maximum Advancing Position |
|---|---|---|---|---|
| Advancing Side Oil Passage F1 | OFF | | ON | |
| Lock Pin Oil Passage F3 | OFF | | ON → OFF | |

(6) Shift from Maximum Advancing Position to Maximum Retarding Position

The rotor 31 shifts from the maximum advancing position to the maximum retarding position at once in the same manner as in the foregoing Embodiment 1.

Table 8 shows the condition of applying (ON) and releasing (OFF) oil pressure to each oil passage in shifting of Maximum Advancing Position→Maximum Retarding Position.

TABLE 8

| | Maximum Retarding Position | ← ← | Maximum Advancing Position |
|---|---|---|---|
| Advancing Side Oil Passage F1 | | OFF | |
| Lock Pin Oil Passage F3 | | OFF | |

As described above, in this Embodiment 2, it is possible to regulate the rotor 31 in the housing 30 to be at the maximum retarding position by engaging the lock pin 44 with the first engaging hole 48 and regulate the rotor 31 in the housing 30 to be at the intermediate angle position by engaging the lock pin 44 with the second engaging hole 49 using the same lock pin 44. It is also possible to shift and hold the rotor 31 in the housing 30 to be at the maximum advancing position. In this Embodiment 2, it is possible to make the three-stage control of lock pin maximum retarding position, intermediate angle position, and maximum advancing position, and attain a valve timing adjusting apparatus wherein the control valve is easily controlled. Number of the lock pins is decreased and the housing is small-sized.

Embodiment 3

Figure 9:
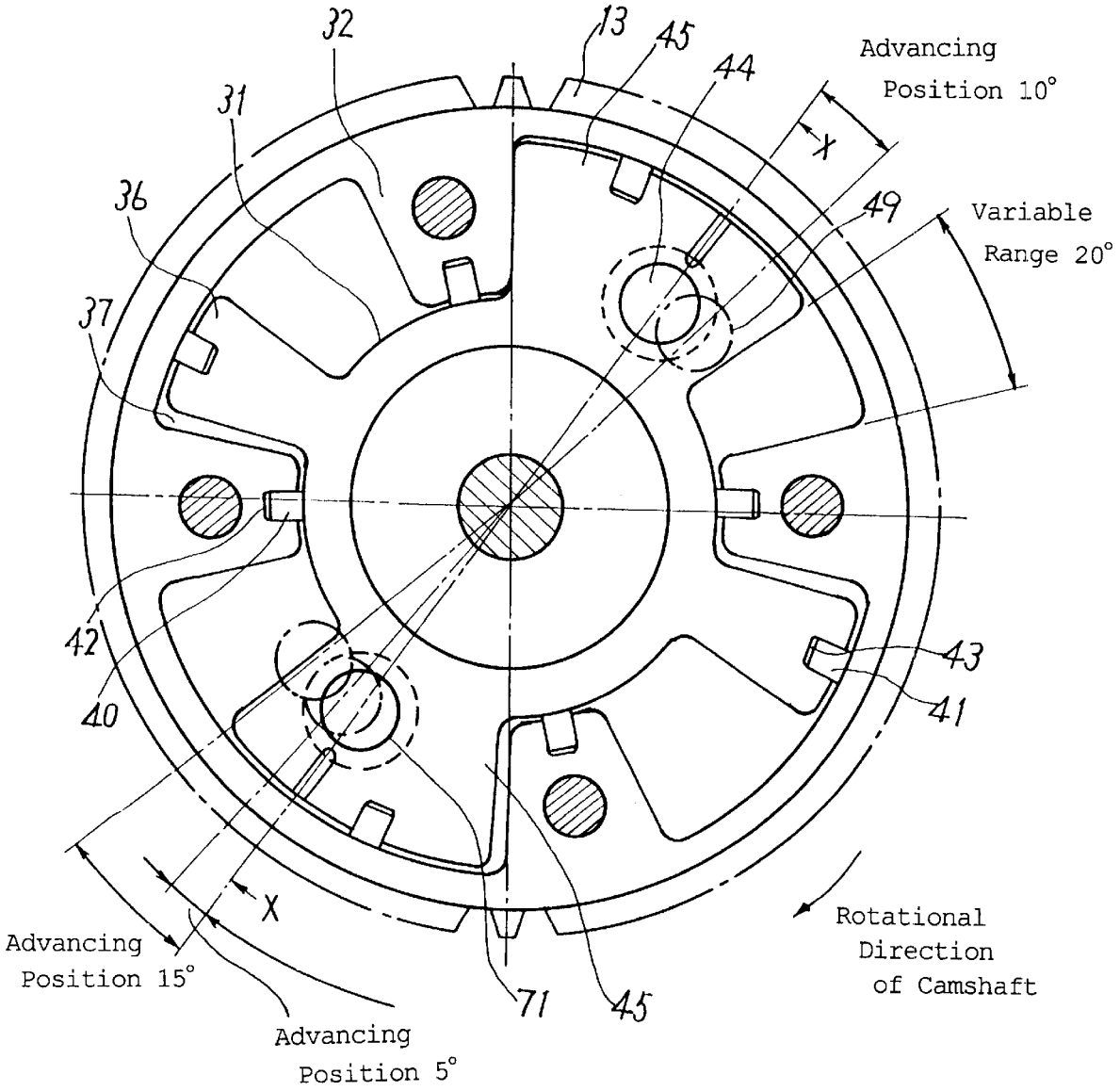
FIG. 9 is a sectional view of a valve timing adjusting apparatus according to Embodiment 3 of the invention taken along the line IX—IX of FIG. 10.
Figure 10:
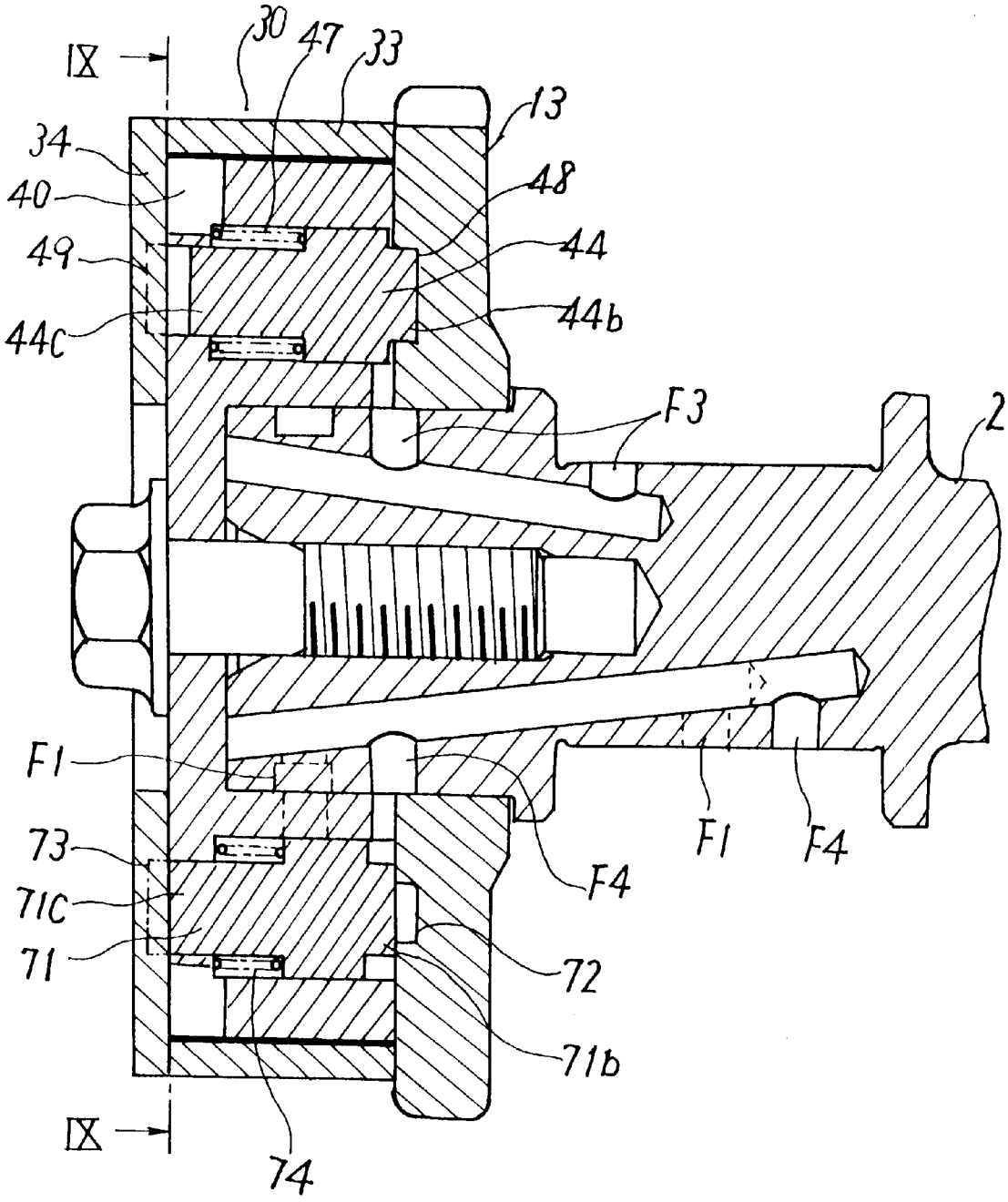
FIG. 10 is a sectional view of the valve timing adjusting apparatus according to Embodiment 3 taken along the line X—X of FIG. 9.

FIG. 9 is a sectional view of a valve timing adjusting apparatus according to Embodiment 3 of the invention taken along the line IX—IX of FIG. 10. FIG. 10 is a sectional view of the valve timing adjusting apparatus according to Embodiment 3 taken along the line X—X of FIG. 9. In the drawings, the same reference numerals as those of Embodiment 1 are designated to the same or like parts, and further description thereof is omitted herein.

In the drawings, four fluid chambers, that is, hydraulic chambers are formed between the four shoes 32 of the case 33 of the housing 30. The hydraulic chambers are partitioned by the four vanes 36 of the rotor 31 which rotates relatively in the housing 30 so as to form the advancing hydraulic chamber 37 in each of the hydraulic chambers. Oil pressure is not applied to the four chambers corresponding to the retarding hydraulic chambers 38 in the foregoing Embodiment 1. The four vanes 36 of the rotor 31 include two wide vanes 45 being symmetrical putting the axis therebetween, and the wide vanes 45 are provided with first and second lock pins 44, 71 in the same manner as in Embodiment 1.

The first engaging hole 48, in which the small diameter portion 44*b* of the first lock pin 44 is inserted, is formed on the sprocket 13. The position of the rotor 31 with respect to the housing 30 is formed at the maximum retarding position, under the condition that the small diameter portion 44*b* of the first lock pin 44 is inserted into the first engaging hole 48. The second engaging hole 49, in which the small diameter portion 44*c* of the first lock pin 44 is inserted, is formed on the cover 34 of the housing 30. The position of the rotor 31 with respect to the housing 30 is formed at 2/4 of the advancing side in the variable angular range (for example, at the advancing position of 10° when the variable angular range is 20°) under the condition that the small diameter portion 44*c* of the first lock pin 44 is inserted into the second engaging hole 49.

A third engaging hole 72 in which a small diameter portion 71*b* of the second lock pin 71 is inserted is formed on the sprocket 13, and the position of the rotor 31 with respect to the housing 30 is formed at 1/4 of the advancing side in the variable angular range (for example, at the advancing position of 5° when the variable angular range is 20°) under the condition that the small diameter portion 71*b* of the second lock pin 71 is inserted into the third engaging hole 72. A fourth engaging hole 73 in which a small diameter portion 71*c* of the second lock pin 71 is inserted is formed on the cover 34 of the housing 30, and the position of the rotor 31 with respect to the housing 30 is formed at 3/4 of the advancing side in the variable angular range (for example, at the advancing position of 15° when the variable angular range is 20°) under the condition that the small diameter portion 71*c* of the second lock pin 71 is inserted into the fourth engaging hole 73.

In the same manner as the first lock pin 44, the second lock pin 71 is urged toward the sprocket 13 by the spring 74. In this Embodiment 3, it is certain that the apparatus is provided with the advancing side oil passage F1 for applying and releasing oil pressure to the advancing hydraulic chamber 37, the oil passage F3 for applying and releasing oil pressure to move the first lock pin 44 against the spring 47, and the oil passage F4 for applying and releasing oil pressure to move the second lock pin 71 against the spring 74. But, note that the apparatus is not provided with the retarding side oil passage F2 and the washer 8 existing in the foregoing Embodiment 1. Therefore, a simple valve is sufficient for the first oil control valve 5 for controlling oil pressure of the oil passage F1 on the advancing side as well as for the second oil control valve 6. A simple valve is also sufficient for the third oil control valve for controlling oil pressure of the oil passage F4 as well as for the second oil control valve 6. Operation of the first and second lock pins is the same as the operation of the lock pin in Embodiment 1.

(1) Shift from Maximum Retarding Position to 1/4 Advancing Position Advancing Position 5°)

Described hereinafter is operation. The relative rotational angle of the crankshaft 19, that is, the housing 30 and the rotor 31 is changed as described below. For example, in order to perform a relative rotation to the advancing side when the initial condition is at the maximum retarding position in which any oil pressure is not applied to each oil passage as shown in FIG. 9 and FIG. 10, oil is applied to the oil passage F3 (F3: ON) through the second oil control valve 6. Thus, the first lock pin 44 moves toward the cover 34 side against the spring 47, and the small diameter portion 44*b* of the lock pin 44 gets out of the first engaging hole 48 of the sprocket 13. At this moment, the small diameter portions 71*b*, 71*c* of the second lock pin 71 are inserted into neither of the third and fourth engaging holes 72, 73, and oil pressure is not applied to the oil passage F4 (F4: OFF).

Under this condition, when supplying oil to the advancing hydraulic chamber 37 via the first oil control valve 5 through the oil passage F1 on the advancing side (F1: ON), the rotor 31 rotates toward the advancing side against the cam reaction force of the camshaft 2. When the relative angle of the rotor 31 inserted into the housing 30 comes to the 1/4 of the advancing position (for example, 5°) in the variable angular range(for example, 20°), the second lock pin 71 is moved toward the sprocket 13 by the urging force of the spring 74, and the small diameter portion 71*b* of the second lock pin 71 can be inserted into the third engaging hole 72 of the sprocket 13. Thus, the rotor 31 is regulated to be at the 1/4 of the advancing position.

(2) Shift from 1/4 Advancing Position (Advancing Position 5°) to 2/4 Advancing Position (Advancing Position 10°)

Then, oil pressure is applied to the oil passage F4 (F4: ON), and the small diameter portion 71*b* of the lock pin 71 gets out of the third engaging hole 72 of the sprocket 13 against the spring 74 and oil pressure is continuously applied to the oil passage F3 (F3: ON). When supplying oil continuously to the advancing hydraulic chamber 37 through the oil passage F1 on the advancing side (F1: ON), the rotor 31 rotates toward the advancing side against the cam reaction force and reaches 2/4 of the advancing position, and the small diameter portion 44*c* of the first lock pin 44 is inserted into the second engaging hole 49 of the cover 34. The rotor 31 is regulated to be at 2/4 of the advancing position by continuously supplying oil to the oil passage F3.

(3) Shift from 2/4 Advancing Position (Advancing Position 10°) to 3/4 Advancing Position (Advancing Position 15°)

Next, when releasing the oil passage F3 from oil pressure (F3: OFF), the small diameter portion 44*c* of the first lock pin 44 gets out of the second engaging hole 49 of the cover 34 by the urging force of the spring 44. Under this condition, oil pressure is continuously applied to the oil passage F4 (F4: ON) and oil is continuously supplied to the advancing hydraulic chamber 37 through the oil passage F1 on the advancing side (F1: ON). Thus, the rotor 31 rotates toward the advancing side against the cam reaction force and reaches 3/4 of the advancing position, and the small diameter portion 71*c* of the second lock pin 71 is inserted into the fourth engaging hole 73 of the cover 34. The rotor 31 is regulated to be at 3/4 of the advancing position by continuously supplying oil to the oil passage F4.

(4) Shift from 3/4 Advancing Position (Advancing Position 15°) to Maximum Advancing Position Under this condition, the oil passage F4 is released from oil pressure (F4: OFF), the oil passage F3 is continuously released from oil pressure (F3: OFF), and oil is continuously supplied to the advancing hydraulic chamber 37 through the oil passage F1 on the advancing side (F1: ON). Consequently, the rotor 31 rotates toward the advancing side against the cam reaction force, and the vanes 36 of the rotor 31 comes in contact with the shoes 32 of the housing 30 and the rotor 31 shifts to the maximum advancing position. The rotor 31 is regulated to be at the maximum advancing position by keeping continuously supplying oil to the advancing hydraulic chamber 3 through the oil passage F1 on the advancing side.

Table 9 shows the condition of applying (ON) and releasing (OFF) oil pressure to each oil passage in shifting of Maximum Retarding Position→Advancing Position 5°→Advancing Position 10°→Advancing Position 15°→Maximum Advancing Position.

TABLE 9

| | Init. | Max Retarding | → | Advancing 5° | → | Advancing 10° | → | Advancing 15° | → | Max Advancing |
|---|---|---|---|---|---|---|---|---|---|---|
| Advancing Side Oil Passage F1 | OFF | | ON | | ON | | ON | | ON | |
| Locking Pin Oil Passage F3 | OFF | | ON | | ON | | OFF | | OFF | |
| Lock Pin Oil Passage F4 | OFF | | OFF | | ON | | ON | | OFF | |

(5) Shift from Maximum Advancing Position to 3/4 Advancing Position (Advancing Position 15°)

In order to shift the rotor 31 from the maximum advancing position to 3/4 of the advancing position, oil supply to the advancing hydraulic chamber 37 is released and oil is discharged through the oil passage F1 on the advancing side (F1: OFF). Thus, the rotor 31 is rotated by cam reaction force of the camshaft 2. When relative angle of the rotor 31 inserted into the housing 30 comes to 3/4 of the advancing position while keeping the application of oil pressure to the oil passage F4 (F4: ON) and keeping the release of the oil passage F3 from oil pressure (F3: OFF), the second lock pin 71 moves toward the cover 34 against the urging force of the spring 74, and the small diameter portion 71*c* is inserted into the fourth engaging hole 73 of the cover 34. Thus, the rotor 31 shifts to 3/4 of the advancing position. The rotor 31 is regulated to be at 3/4 of the advancing position by continuously applying oil pressure to the oil passage F4.

(6) Shift from 3/4 Advancing Position (Advancing Position 15°) to 2/4 Advancing Position (Advancing Position 10°)

Then, in order to shift the rotor 31 from 3/4 of the advancing position to 2/4 of the advancing position, the oil passage F4 is released from oil pressure (F4: OFF), and the small diameter portion 44*c* of the second lock pin 71 gets out of the fourth engaging hole 73 of the cover 34 by the urging force of the spring 74. Under this condition, oil pressure is applied to the oil passage F3 (F3: ON). The advancing side oil passage F1 is continuously released from oil pressure (F1: OFF), and the rotor 31 is rotated by the cam reaction force of the camshaft 2. When the relative angle of the rotor 31 inserted into the housing 30 comes to 2/4 of the advancing position, the first lock pin 44 moves toward the cover 34 against the urging force of the spring 47, and the small diameter portion 44*c* is inserted into the second engaging hole 49 of the cover 34. Thus, the rotor 31 shifts to 2/4 of the advancing position. The rotor 31 is regulated to be at 2/4 of the advancing position by continuously applying oil pressure to the oil passage F3.

(7) Shift from 2/4 Advancing Position (Advancing Position 10°) to 1/4 Advancing Position (Advancing Position 5°)

In order to shift the rotor 31 from 2/4 of the advancing position to the 1/4 advancing position, the oil passage F3 is released from oil pressure (F3: OFF), and the small diameter portion 44*c* of the first lock pin 44 gets out of the second engaging hole 49 of the cover 34 by the urging force of the spring 47. The oil passage F4 is continuously released from oil pressure (F4: OFF). The oil passage F1 on the advancing side is continuously released from oil pressure (F1: OFF), and the rotor 31 is rotated by the cam reaction force of the camshaft 2. When the relative angle of the rotor 31 inserted into the housing 30 comes to 1/4 of the advancing position, the small diameter portion 71*b* of the second lock pin 71 is inserted into the third engaging hole 72 of the sprocket 13 by the urging force of the spring 47. The rotor 31 shifts to 1/4 of the advancing position and is regulated to be at 1/4 of the advancing position.

(8) Shift from 1/4 Advancing Position (Advancing Position 5°)to Maximum Retarding Position In order to further shift the rotor 31 from the 1/4 advancing position to the maximum retarding position, oil pressure is applied to the oil passage F4 (F4: ON). Thus, the small diameter portion 71*b* of the second lock pin 71 gets out of the third engaging hole 72 of the sprocket 13 against the urging force of the spring 74. The oil passage F3 is kept being released from oil pressure (F3: OFF). When the advancing side oil passage F1 is continuously released from oil pressure (F1: OFF), the rotor 31 is rotated by the cam reaction force of the camshaft 2. When the relative angle of the rotor 31 inserted into the housing 30 comes to the maximum retarding position, the lock pin 44 is moved toward the sprocket 13 side by the urging force of the spring 47, and the small diameter portion 44*b* of the lock pin 44 is inserted into the first engaging hole 48 of the sprocket 13. Thus, the rotor 31 shifts to the maximum retarding position. The rotor 31 is regulated to be at the maximum retarding position by not applying oil pressure to the oil passage F3.

Table 10 shows the condition of applying (ON) and releasing (OFF) oil pressure to each oil passage in shifting of Maximum Advancing Position→Advancing Position 15°→Advancing Position 10°→Advancing Position 5°→Maximum Retarding Position.

TABLE 10

| | Init. | Max Retarding | Advancing ← 5° | Advancing ← 10° | Advancing ← 15° | Max ← Advancing |
|---|---|---|---|---|---|---|
| Advancing Side Oil Passage F1 | | | OFF | OFF | OFF | OFF |
| Lock Pin Oil Passage F3 | | | OFF | OFF | ON | OFF |

TABLE 10-continued

| | Init. | Max Retarding | Advancing ← 5° | Advancing ← 10° | Advancing ← 15° | Max Advancing |
|---|---|---|---|---|---|---|
| Lock Pin Oil Passage F4 | | | ON | OFF | OFF | ON |

As described above, in this Embodiment 3, it is possible to regulate the rotor 31 in the housing 30 to be at the maximum retarding position by engaging the first lock pin 44 with the first engaging hole 48 and regulate the rotor 31 in the housing 30 to be at 2/4 of the advancing position by engaging the first lock pin 44 with the second engaging hole 49. It is also possible to regulate the rotor 31 in the housing 30 to be at 1/4 of the advancing position by engaging the second lock pin 71 with the third engaging hole 72 and regulate the rotor 31 in the housing 30 to be at 3/4 of the advancing position by engaging the second lock pin 71 with the fourth engaging hole 73. It is further possible to shift the rotor 31 in the housing 30 to the maximum advancing position. Thus, in this Embodiment 3, it is possible to make five-stage control of the maximum retarding position, 1/4 of the advancing position, 2/4 of the advancing position, 3/4 of the advancing position, and maximum advancing position. As a result, the valve timing adjusting apparatus can be controlled more minutely and accurately. It is also possible to achieve the valve timing adjusting apparatus in which control valve is easily controlled. Number of the lock pins can be decreased, and it is still possible to regulate the relative rotational position at four places, and the housing is small-sized.

In each of the foregoing embodiments, the apparatus having the advancing hydraulic chamber and the retarding hydraulic chamber and that having only the advancing hydraulic chamber are described. It is, however, preferable that the apparatus has only the retarding hydraulic chamber so long as it is used as VVT on the intake side.

In the apparatus described in each of the foregoing embodiments, the housing is rotatably mounted on the camshaft and the rotor is fixedly mounted on the camshaft. It is also preferable that the rotor is rotatably mounted on the camshaft and the housing is fixedly mounted on the camshaft.

The rotor is provided with the lock pin and the hole for engaging with the lock pin is formed on the housing in the apparatus described in each of the foregoing embodiments. It is also preferable that the housing is provided with the lock pin and the hole for engaging with the lock pin is provided on the rotor.

Furthermore, the lock pin shifts in parallel to the axial direction of the camshaft in the apparatus described in each of the foregoing embodiments. It is also preferable that the lock pin shifts in the radial direction of the camshaft.

It is to be understood that the invention is not limited to the foregoing embodiments and various changes and modifications may be made without departing from the spirit and scope of the invention.

What is claimed is:

1. A valve timing adjusting apparatus of an internal combustion engine comprising:

a housing, which is mounted on a camshaft of the internal combustion engine so as to be rotatable relative to the camshaft about a rotation axis, having a plurality of fluid chambers partitioned by shoes;

a rotor, which is mounted on the camshaft, having a plurality of vanes respectively partitioning said fluid chambers into advancing chambers and retarding chambers;

a lock pin mounted in said rotor for movement in a slide direction between a first engaged position and a second engaged position, the slide direction being parallel to the rotation axis of said housing; and a first engaging portion and a second engaging portion respectively formed on said housing at different positions of relative rotation of said rotor with respect to said housing, said first and said second engaging portions being spaced apart in the slide direction;

wherein said rotor is selectively fixed at the different positions of relative rotation with respect to said housing by engaging said lock pin with said first and said second engaging portions, respectively.

2. The valve timing adjusting apparatus of an internal combustion engine according to claim 1, further comprising an advancing chamber oil passage for applying oil pressure to said advancing chambers, and a lock pin oil passage for applying oil pressure to move said lock pin against an urging force that urges said lock pin.

3. The valve timing adjusting apparatus of an internal combustion engine according to claim 2, wherein oil pressure is applied to said lock pin oil passage independently of said advancing chamber oil passage.

4. The valve timing adjusting apparatus of an internal combustion engine according to claim 3, wherein said lock pin oil passage is provided with a control valve for controlling application and release of oil pressure to said lock pin oil passage.

5. The valve timing adjusting apparatus of an internal combustion engine according to claim 2, wherein, by applying oil pressure to said lock pin oil passage, a first end of said lock pin and said first engaging portion are disengaged and a second end of said lock pin and said second engaging portion are engaged.

6. The valve timing adjusting apparatus of an internal combustion engine according to claim 2, wherein at least one of said retarding chambers is provided with a retarding urging member.

7. The valve timing adjusting apparatus of an internal combustion engine according to claim 1, wherein the different positions of relative rotation of said rotor with respect to said housing are a maximum retarding position and an approximately intermediate angle position within a variable angular range of relative rotation of said rotor.

8. The valve timing adjusting apparatus of an internal combustion engine according to claim 1, wherein said lock pin has an integral configuration in which plural cylinders are coaxially arranged.

9. The valve timing adjusting apparatus of an internal combustion engine according to claim 1, wherein a first end of said lock pin is engagable with said first engaging portion of said housing and a second end of said lock pin is engagable with said second engaging portion of said housing.

10. A valve timing adjusting apparatus of an internal combustion engine comprising:

a housing which is mounted on a camshaft of the internal combustion engine so as to be relatively rotatable, has a plurality of fluid chambers partitioned by shoes inside, and is driven synchronously by a crankshaft of said internal combustion engine;

a rotor which is mounted on said camshaft and has a plurality of vanes for partitioning said plurality of fluid chambers into advancing chambers and retarding chambers respectively;

a lock pin which is stored in said rotor and is urged so as to be movable toward said housing;

first and second engaging portions which are formed on said housing at different positions of relative rotation of said rotor with respect to said housing and respectively face said lock pin;

a first oil passage for applying oil pressure to said advancing chambers;

a second oil passage for applying oil pressure to said retarding chambers; and a third oil passage for applying oil pressure which moves said lock pin against urging force that urges said lock pin;

wherein said rotor is regulated to be at the different positions of relative rotation with respect to said housing by engaging the same lock pin with said first and second engaging portions respectively, and one end of said lock pin and said first engaging portion are disengaged and the other end of said lock pin and said second engaging portion are engaged by applying oil pressure to said third oil passage.

11. A valve timing adjusting apparatus of an internal combustion engine comprising:

a housing, which is mounted on a camshaft of said internal combustion engine so as to be relatively rotatable, having a plurality of fluid chambers partitioned by shoes, and being driven synchronously by a crankshaft of the internal combustion engine;

a rotor, which is mounted on the camshaft, having a plurality of vanes respectively partitioning said plurality of fluid chambers into advancing chambers and retarding chambers;

a first lock pin stored in said rotor and being urged so as to be movable in a slide direction between a first engaged position and a second engaged position, the slide direction being parallel to a rotation axis of said housing;

a first engaging portion and a second engaging portion respectively formed on said housing at different positions of first and second relative rotation of said rotor with respect to said housing and respectively facing said first lock pin, said first and said second engaging portions being spaced apart in the slide direction;

a second lock pin stored in said rotor and being urged so as to be movable toward said housing; and a third engaging portion and a fourth engaging portion respectively formed at different positions of third and fourth relative rotation which are different from the positions of said first and said second relative rotation on said housing and respectively facing said second lock pin;

wherein said rotor is selectively fixed at positions of multistage relative rotation with respect to said housing by engaging said first lock pin with said first and second engaging portions respectively and engaging said second lock pin with said third and fourth engaging portions, respectively.

* * * * *